US011478075B2

(12) United States Patent
Doherty et al.

(10) Patent No.: US 11,478,075 B2
(45) Date of Patent: Oct. 25, 2022

(54) FOLDABLE SHELVING

(71) Applicant: Armadillo Tough LLC, Boynton Beach, FL (US)

(72) Inventors: Robert Doherty, Boynton Beach, FL (US); Aaron Diamond, Boynton Beach, FL (US)

(73) Assignee: ARMADILLO TOUGH LLC, Boynton Beach, FL (US)

( * ) Notice: Subject to any disclaimer, the term of this patent is extended or adjusted under 35 U.S.C. 154(b) by 0 days.

(21) Appl. No.: 17/342,128

(22) Filed: Jun. 8, 2021

(65) Prior Publication Data

US 2021/0378398 A1 Dec. 9, 2021

Related U.S. Application Data

(60) Provisional application No. 63/036,734, filed on Jun. 9, 2020.

(51) Int. Cl.
*A47B 43/00* (2006.01)

(52) U.S. Cl.
CPC ..... *A47B 43/00* (2013.01)

(58) Field of Classification Search
CPC ..... A47B 43/00; A47B 31/04; A47B 47/0083; A47B 47/027; A47B 47/028; A47B 47/021; A47F 5/10; A47F 5/13; B62B 3/02; B62B 3/002
USPC ..... 211/149, 150, 200, 201; 108/166–168, 108/170–173, 175, 115, 162
See application file for complete search history.

(56) References Cited

U.S. PATENT DOCUMENTS 1,304,847 A * 5/1919 Blais et al. ..... A47F 5/13 211/38
2,938,632 A * 5/1960 Mondineu ..... A47B 31/04 108/106
3,093,247 A * 6/1963 Erickson ..... A47B 43/00 211/149
3,827,376 A * 8/1974 Solomon ..... A47B 43/00 108/177
4,202,278 A * 5/1980 Wadenhed ..... B62B 3/006 248/172
5,131,547 A * 7/1992 Goldberg ..... A47F 5/13 108/177
5,806,864 A * 9/1998 Zielinski ..... B62B 3/02 280/42
6,123,207 A * 9/2000 Mast ..... B62B 3/025 211/149

(Continued)

FOREIGN PATENT DOCUMENTS

CN 209629025 11/2019
EP 2340741 7/2011

(Continued)

*Primary Examiner* — Jennifer E. Novosad
(74) *Attorney, Agent, or Firm* — Akerman LLP

(57) ABSTRACT

A foldable shelving unit includes one or more foldable shelves positioned between first and second frame members. A slide rail pivotably couples between the foldable shelves. A stop is fixed to the slide rail and a slide locking mechanism is slidable along the slide rail. The slide locking mechanism includes a latch to latch to the stop to lock the shelving unit in an unfolded configuration and unlatch to slide the slider along the slide rail away from the stop to fold the shelving unit into a folded configuration.

16 Claims, 6 Drawing Sheets

(56) References Cited

U.S. PATENT DOCUMENTS

| | | | | |
|---|---|---|---|---|
| 7,389,887 | B2 * | 6/2008 | Liang | A47B 43/00 211/149 |
| 8,256,629 | B2 * | 9/2012 | Zhu | A47B 31/04 211/195 |
| 8,672,147 | B2 * | 3/2014 | Lam | A47F 7/24 211/85.3 |
| 9,226,574 | B1 * | 1/2016 | Chen | A47B 96/07 |
| 9,474,368 | B2 * | 10/2016 | Frankel | A47B 43/00 |
| 9,913,533 | B1 * | 3/2018 | Ke | B62B 3/002 |
| 10,292,491 | B1 * | 5/2019 | Ke | A47F 5/137 |
| 10,604,170 | B1 * | 3/2020 | Davis | B62B 3/008 |
| 11,116,313 | B2 * | 9/2021 | Leung | A47B 43/00 |
| 11,172,759 | B2 * | 11/2021 | Liu | A47B 47/028 |
| 11,208,132 | B2 * | 12/2021 | Chen | B62B 3/02 |
| 11,246,408 | B2 * | 2/2022 | Jiang | A47B 43/00 |
| 2011/0155680 | A1 * | 6/2011 | Pong | A47B 43/00 211/199 |
| 2011/0253660 | A1 * | 10/2011 | Pong | A47B 43/00 211/198 |
| 2021/0378398 | A1 * | 12/2021 | Doherty | A47B 43/00 |

FOREIGN PATENT DOCUMENTS

| | | |
|---|---|---|
| EP | 2445375 | 3/2013 |
| KR | 101613689 | 4/2016 |
| KR | 20170000391 | 1/2017 |

* cited by examiner

FOLDABLE SHELVING

CROSS-REFERENCE TO RELATED APPLICATIONS

This patent application claims the benefit of U.S. Provisional Patent Application No. 63/036,734, filed Jun. 9, 2020, the contents of which are hereby incorporated by reference in their entirety.

TECHNICAL FIELD

The present application is directed to shelving, and more specifically foldable shelving.

BACKGROUND

Shelving typically includes one or more supported platforms or shelves upon which objects may be placed. Shelves may be supported by vertical posts, walls, or other structures. Common shelving designs include multiple vertically stacked shelves attached to vertical posts or frame members, typically along one or more edges of the shelves, but other locations have been used. Shelving can be found nearly everywhere, such as in homes supporting knickknacks, tools, books, or photos; in libraries supporting books; in grocery stores lined with food items; warehouses supporting boxes; or in stores supporting items for sale.

Storage and assembly of shelving can be cumbersome. One way to address this is to use foldable shelving to fold shelf components into a smaller formfactor for storage and then unfold the shelving when needed. Drawbacks of foldable shelving include instability due to the fold design and the desire for utilization of lightweight materials. Other drawbacks of foldable shelving include complicated and awkward assembly due to the fold design or mechanism used to hold the shelving in a folded or unfolded state. What is needed are improved foldable shelving designs that enhance stability as well as ease of assembly.

SUMMARY

In one aspect, a foldable shelving unit includes a slider bracket configured to slide along a vertically extending rail and is pivotably connected to lateral sides of the shelving unit via two or more connecting rods. The slider may include a latch configured to engage a stop located at a fixed position on the vertical rail to provide a trestle framework support when latched to the bracket.

In one example, the latch is biased toward the vertically extending rail to encourage the latch to latch to the stop. The slider and stop may include interfacing surfaces that engage when weight is placed on shelving to distribute weight toward the sides of the foldable shelving unit.

In one example, the latch is dimensioned to auto latch to the stop when extended along the vertical rail when unfolding the shelving unit. For example, the latch may include an upper surface that is positioned to engage a surface of the stop when the slider is slid to the stop. The upper surface may be angled to lift the latch away from and over the stop as the slider is slid further upwards toward the latch to allow the bias of the latch to position the latch over the stop.

To fold the shelving unit, the latch may be released and the slider may be slid along the vertical rail, away from the stop, and the shelves may fold relative to connections with the vertical rail and lateral sides of the unit.

In another aspect, a foldable shelving unit includes one or more shelves, each shelf including a first shelf member and a second shelf member; a first frame member and a second frame member, the first frame member pivotably coupled to the first shelf member at a first pivot and the second frame member pivotably coupled to the second shelf member at a second pivot; a slide rail; a third pivot pivotably coupling the first shelf member, second shelf member, and slide rail; a stop fixed to the slide rail; and a slide locking mechanism. The slide locking mechanism may include a slider configured to slide along the slide rail, a first connector pivotably coupled to the slider at a first end and pivotably coupled to the first pivot at a second end, a second connector pivotably coupled to the slider at a first end and pivotably coupled to the second pivot at a second end, a latch configured to latch to the stop when the unit is in an unfolded configuration and unlatch from the stop to transition the unit to a folded configuration, and an engagement surface to engage and engagement surface of the stop when the unit is in a folded configuration.

The latch may be configured for auto latching. In one example, the latch is biased toward the stop. In the above or another example, the latch includes a projection having an angled upper surface configured to engage the stop when the slider is slid toward the stop and progressively lift the projection as the slider slides a latch surface of the projection above a latch surface of the stop to allow the bias to position the latch surface of the projection over the latch surface of the stop.

In some examples, the second end of the first connector may position between the first shelf member and the first frame member. The second end of the second connector may position between the second shelf member and the second frame member.

In another example, the second end of the first connector may position more rearward than that of the first shelf member and the first frame member. The second end of the second connector may position more rearward than the second shelf member and the second frame member.

In an above or another example, when weight is positioned on the one or more shelves, the engagement surfaces of the slide locking engagement mechanism and stop engage and downward directed force is applied to the slider. In a further example, the downward directed force on the slider may be transferred to the first and second frame members by the first and second connectors.

In an above or another example, the stop may include a slot to receive the latch.

In an above or another example, the slider may include a slot to receive the stop. In a further example, the engagement surface of the slider may be located along a lower surface of the slot.

In an above or another example, the first ends of the first and second connectors pivotably couple to the slider at a same pivot. In another example, the first ends of the first and second connectors pivotably couple to the slider at separate pivots.

In an above or another example, the unit includes one or more casters.

In an above or another example, the unit includes a hanger.

BRIEF DESCRIPTION OF THE DRAWINGS

Novel features of the present invention are set forth with particularity in the appended claims. However, the various embodiments of the present invention described herein, both as to organization and manner of operation, may be best understood by reference to the following description, taken in conjunction with the accompanying drawings in which:

DESCRIPTION

Figure 1A:
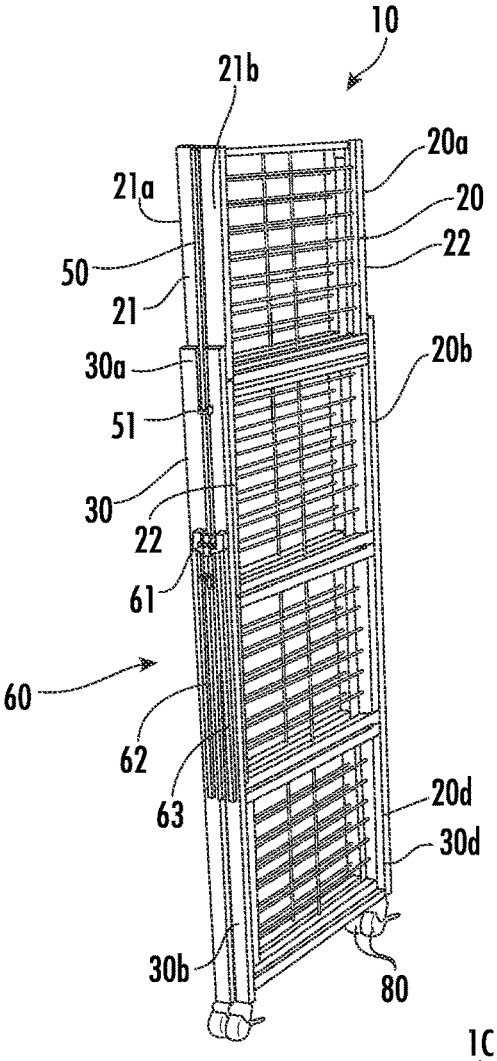
FIG. 1A is a perspective view of a foldable shelving unit in a folded configuration according to various embodiments described herein.

FIGS. 1A-2D illustrate foldable shelving according to various embodiments of the present disclosure wherein like numbers identify like features.

The foldable shelving unit 10 includes one or more shelves 20, which may be individually identified as 20*a*, 20*b*, 20*c*, 20*d*. The one or more shelves 20 are supportable by one or more frame members 30, which may be individually identified as 30*a*, 30*b*, 30*c*, 30*d*.

Shelves 20 may include a first shelf member 21 and a second shelf member 21. First shelf members 21 may be pivotably coupled to second shelf members 22 at a pivot 23 to allow folding of the shelf 20. Pivots 23 may include any suitable pivot structures. For example, pivots 23 may include pins upon which the shelf members 21, 22 may pivot relative to each other. In another example, pivots 23 may include hinges which may or may not be associated with brackets. Shelf members 21, 22 may optionally include a shelf frame 21*a*, 22*a* to provide additional stability. A bracket 24*a*, 24*b* may extend from each shelf frame 21*a*, 22*a* to pivotably couple to pivot 23. In the illustrated embodiments, shelves 20 pivot on pivots 23 such that undersides of the shelf members 21, 22 direct toward each other. However, in other embodiments, the shelf members 21, 22 may pivot such that upper surfaces of the shelf members 21, 22 direct toward each other when folded.

In the illustrated embodiments, four frame members 30*a*, 30*b*, 30*c*, 30*d* are shown, however, in other embodiments fewer or additional frame members 30 may be used. The frame members 30 attach to each shelf 20 at a pivot 40, which may be individually identified as 40*a*, 40*b*, 40*c*, 40*d*. Pivots 40 are located at or adjacent to lateral ends of front and rear facing portions of the shelves 20. In some embodiments, pivots 40 may be positioned at other locations, such as at more inwardly positioned locations or along lateral facing sides of shelves 20. Pivots 40 may include any suitable pivot mechanism. For example, pivots 40 may include pins upon which the components may pivot relative to each other. In another example, pivots 40 may include hinges which may or may not be associated with brackets. For instance, hinged brackets may be positioned along or adjacent to lateral facing sides of a shelf 20 for pivotably coupling to a frame member 30.

A slide rail 50 pivotably couples at pivots 23 to pivot relative to first and second shelf members 21, 22. A slide lock mechanism 60 is provided to allow lockable folding and unfolding of the foldable shelving unit 10. The slide lock mechanism 60 includes a slider 61 configured to slide along the slide rail 50. The slider 61 pivotably couples to a first end 62*a*, 63*a* of one or more connectors 62, 63, each of which pivotably couples to a shelf member 21, 22 and/or frame member 30*a*, 30*b* at a second end 63*a*, 63*b*. In the illustrated embodiments, a first end 62*a* of a first connector 62 pivotably couples to the slider 61 at a first pivot 64*a* and a second end 62*b* of the first connector 62 pivotably couples to pivot 40*a* to pivotably couple the second end 62*b* to a first frame member 30*a* and the first shelf member 21. A first end 63*a* of a second connector 63 pivotably couples to the slider 61 at a second pivot 64*b* and a second end 63*b* of the connector 63 pivotably couples to pivot 40*b* to pivotably couple the second end 63*b* to a second frame member 30*a* and the second shelf member 22. In other embodiments, first ends 62*a*, 63*a* of connectors 62, 63 may pivotably couple at a same pivot positioned on slider 61.

The slider 61 includes a slot 64 for slidably receiving the slide rail 50. The slot 64 extends entirely around the slide rail 50 or may extend only around a portion of the perimeter of the slide rail 50. In some embodiments, the slider 61 may slidably couple to the slide rail 50 in other slidable configurations. For example, rail and groove structures may be used to slidably couple the slide rail 50 and the slider 61.

The slider 61 also includes a latch 66 for latching to a stop 51 fixed to the slide rail 50 to lock the position of the slider 61 relative to the slide rail 50. The latch 66 includes a latch projection 67 having a latch surface 68 and an optional auto latch surface 69. The latch surface 68 is configured to be latched to the stop 51 at latch surface 52 located along an upper surface of the stop 51. The latch surface 68 may interface with latch surface 51 when the latch 66 latches to the stop 51. The corresponding latch surfaces 52, 68 may be flat; however, in some embodiments the latch surfaces 52, 68 may include contours to improve retention of latching. The latch 66 may pivotably attach to slider 51 at pivot 70. The latch 66 is preferably biased at pivot 70 to bias the latch projection 67 toward the slide rail 50 to maintain the latch surface 68 of the latch over latch surface 52 of the stop 51 when the foldable shelving unit 10 is unfolded. In the illustrated embodiments, the stop 51 includes a slot 53 for receiving the latch projection 67 having sidewalls that locate adjacent to the latch when the latch surface 68 positions above the latch surface of the stop 51.

As introduced above, the latch 66 may include an auto latching surface 69. In the illustrated embodiment, the auto latching surface 69 comprises an upper surface of the latch projection 67 that angles downwardly toward the slide rail 50 such that when the slider 61 is slid up to the stop 51, the upper surface of the projection 67 comprising the auto latching surface 69 engages a portion of the stop 51 below the latch surface 52 of the stop 51 and continued upward movement of the slider 61 along the slide rail 51 causes lifting of the projection 67 away from the slide rail 51, over the stop, to allow the bias of the latch 66 to extend the latch projection 67 over the latch surface 52 to interface the latch surface 68 therewith.

When latched, the foldable shelving is in an unfolded configuration suitable for providing a sturdy support for objects to be shelved. The stop 51 and slider 61 also include engagement surfaces 54, 68 configured to engage when weight is applied to shelves 20 to distribute the weight to the sides of the shelves, e.g., onto the frame members. Engagement of the engagement surfaces 54, 68 may also apply an outward unfolding force further stabilizing the unfolded configuration of the shelves 20. The engagement surfaces 54, 68 may typically be flat surfaces; however, in some embodiments, the engagement surfaces 54, 68 may include contours.

The illustrated embodiments include optional lateral stop sides 55*a*, 55*b* that extend laterally outwardly beyond the slide rail 50. The sides 55*a*, 55*b* are dimensioned to be received along with the engagement surface 54 in retention slot 75. The slot 75 has a "U" shape wherein engagement surface 68 extends along a lower portion and is positioned between lateral sidewalls 75*a*, 75*b* (see, e.g., FIG. 2B). The lateral walls 75*a*, 75*b* may approximate the dimensions of the stop 51 such that lateral movement of the engagement surfaces 54, 68 is limited when the stop 51 is received within the slot 75. The lateral offset may provide available clearance between the slider 61 slot 65 and the slide rail 51 to improve ease of sliding the slider 61 along the slide rail 51.

To release the latch projection 67 from the stop 51, the release arm 71 may be pressed to pivot the latch 66 on pivot 70 to extend the latch projection 67 away from the slid rail 50 and clear the latch surface 52 of the stop 51. The slider 62 may then be slid down the slide rail 50 to fold the foldable shelving 1. In the illustrated embodiment, pivot 70 comprises a biased hinge. In other embodiments, the latch projection 67 may be biased toward the slide rail 50 by another bias member such as a spring. A button or other structure may be provided to release or overcome the bias to extend the latch projection 67 away from the slid rail 50 and clear the latch surface 52 of the stop 51.

Figure 1B:
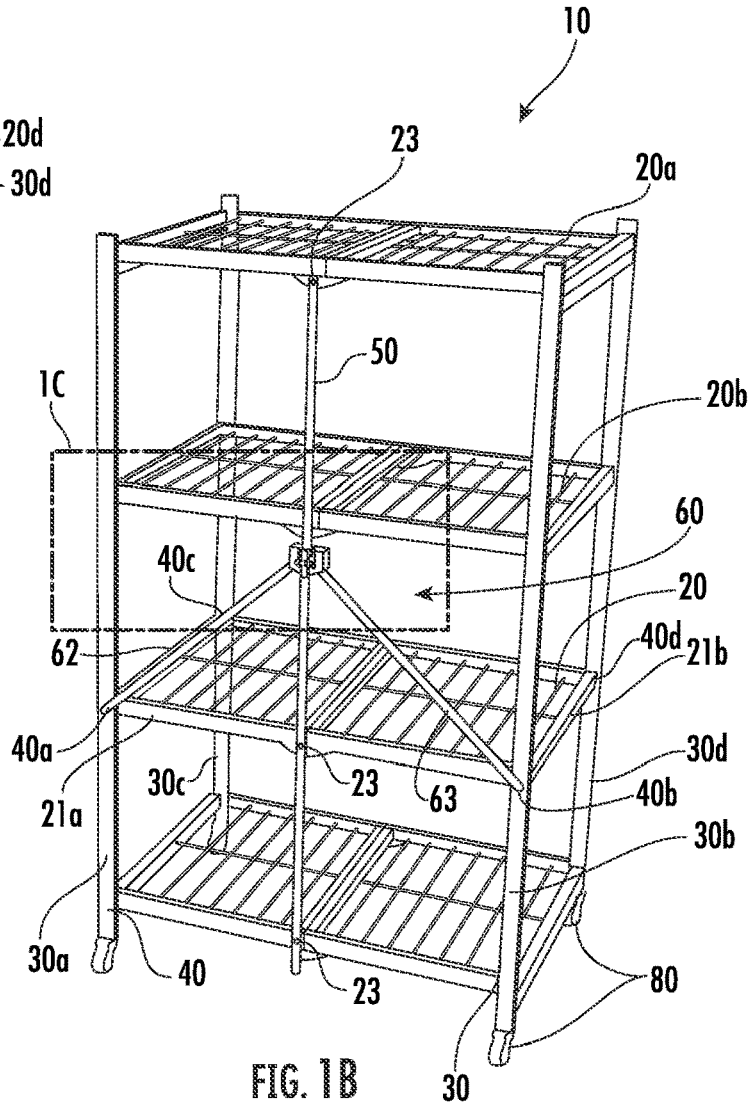
FIG. 1B is a perspective view of the foldable shelving unit in FIG. 1B in an unfolded configuration according to various embodiments described herein.
Figure 1C:
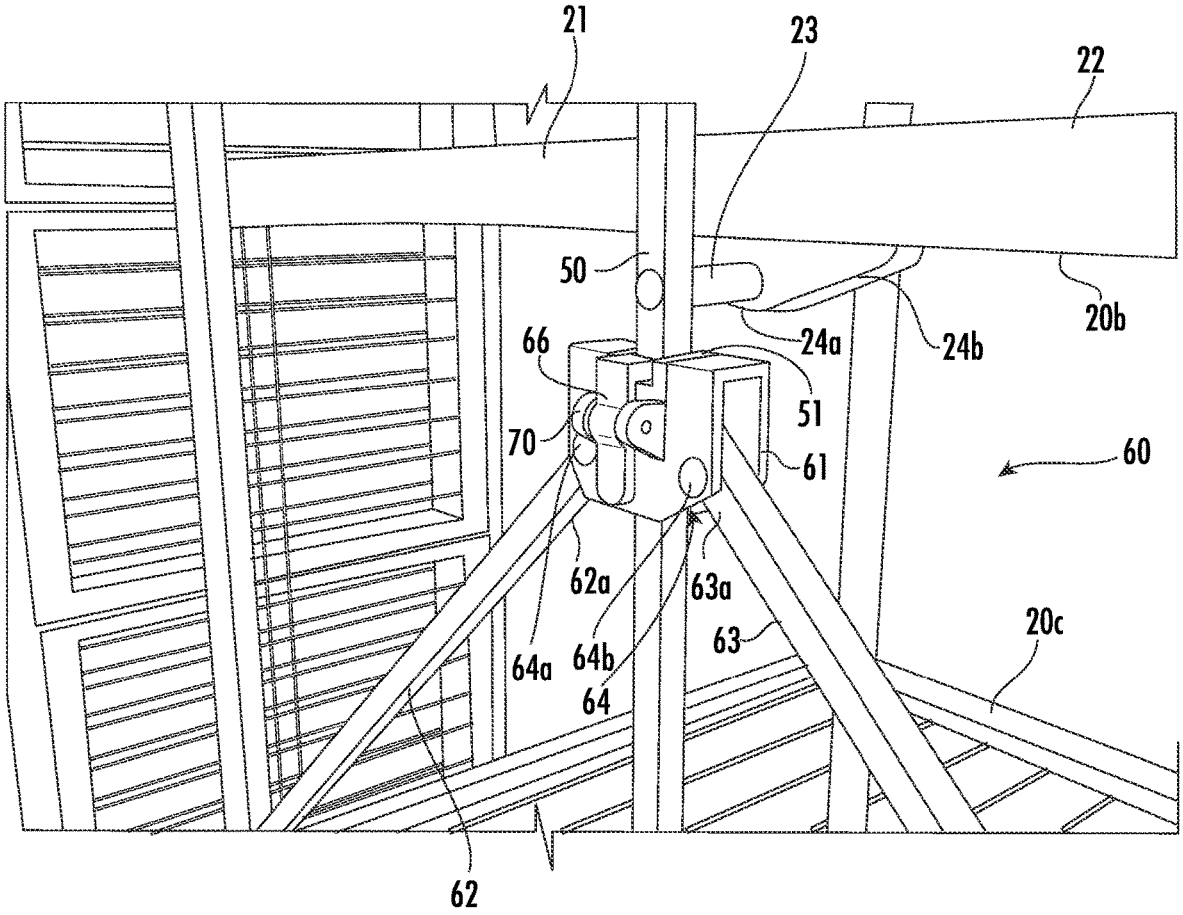
FIG. 1C is a magnified view taken from box 1C in FIG. 1B according to various embodiments described herein.

FIG. 1A shows an example of the foldable shelving unit 10 in a folded configuration, and FIG. 1B shows an example of the foldable shelving unit 10 in an unfolded configuration where the latch 66 of the slide locking mechanism 60 is latched to the stop 51, as better shown in the magnified view provided in FIG. 1C. The foldable shelving unit 10 is also shown with optional wheels or casters 80 for ease of transport.

FIGS. 2A-2D show another example of the foldable shelving. This embodiment is similar to the embodiment illustrated in FIGS. 1A-1C but with second ends 62*b*, 63*b* of connectors 62, 63 respectively connected at pivots 40*a*, 40*b* between frame members 30*a*, 30*b* and rear facing lateral ends of the first and second shelf members 21, 22, rather than exterior to the same.

Figure 2A:
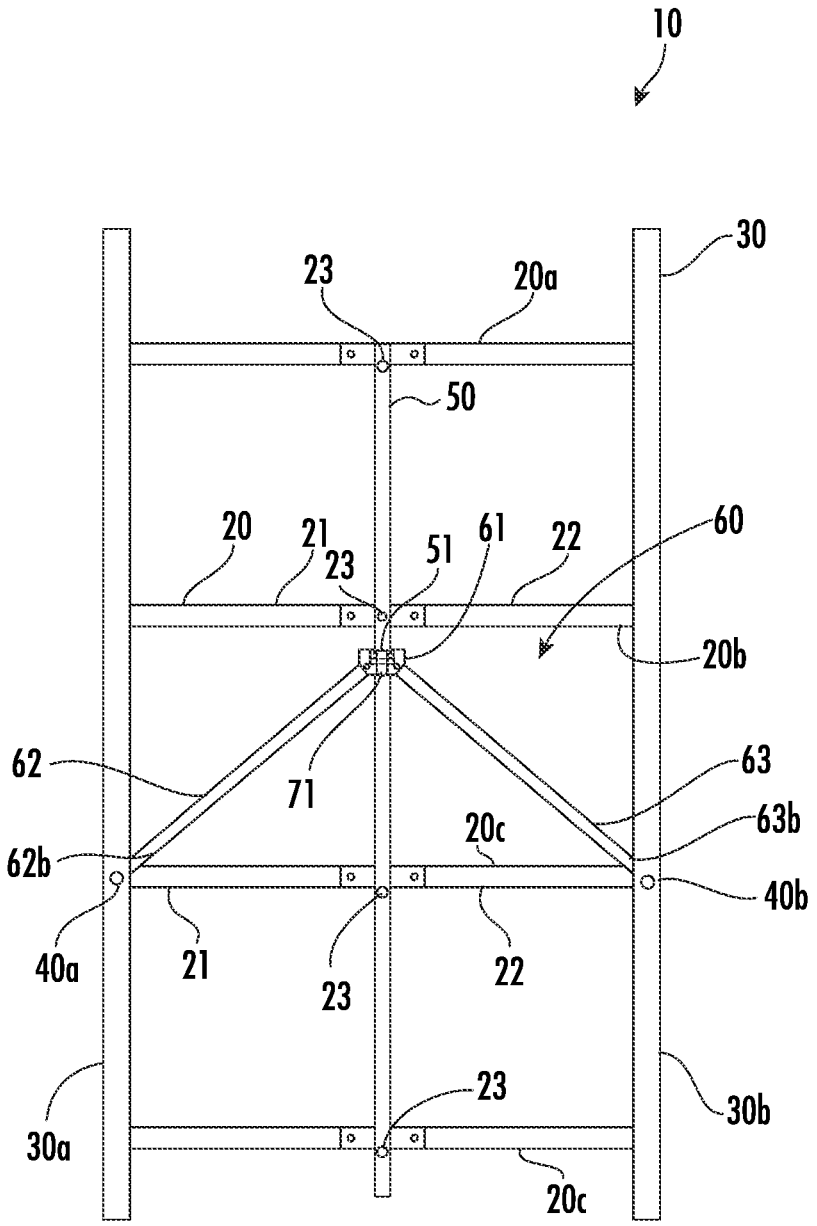
FIG. 2A is an elevated rear view of a foldable shelving in an unfolded configuration according to various embodiments described herein.
Figure 2B:
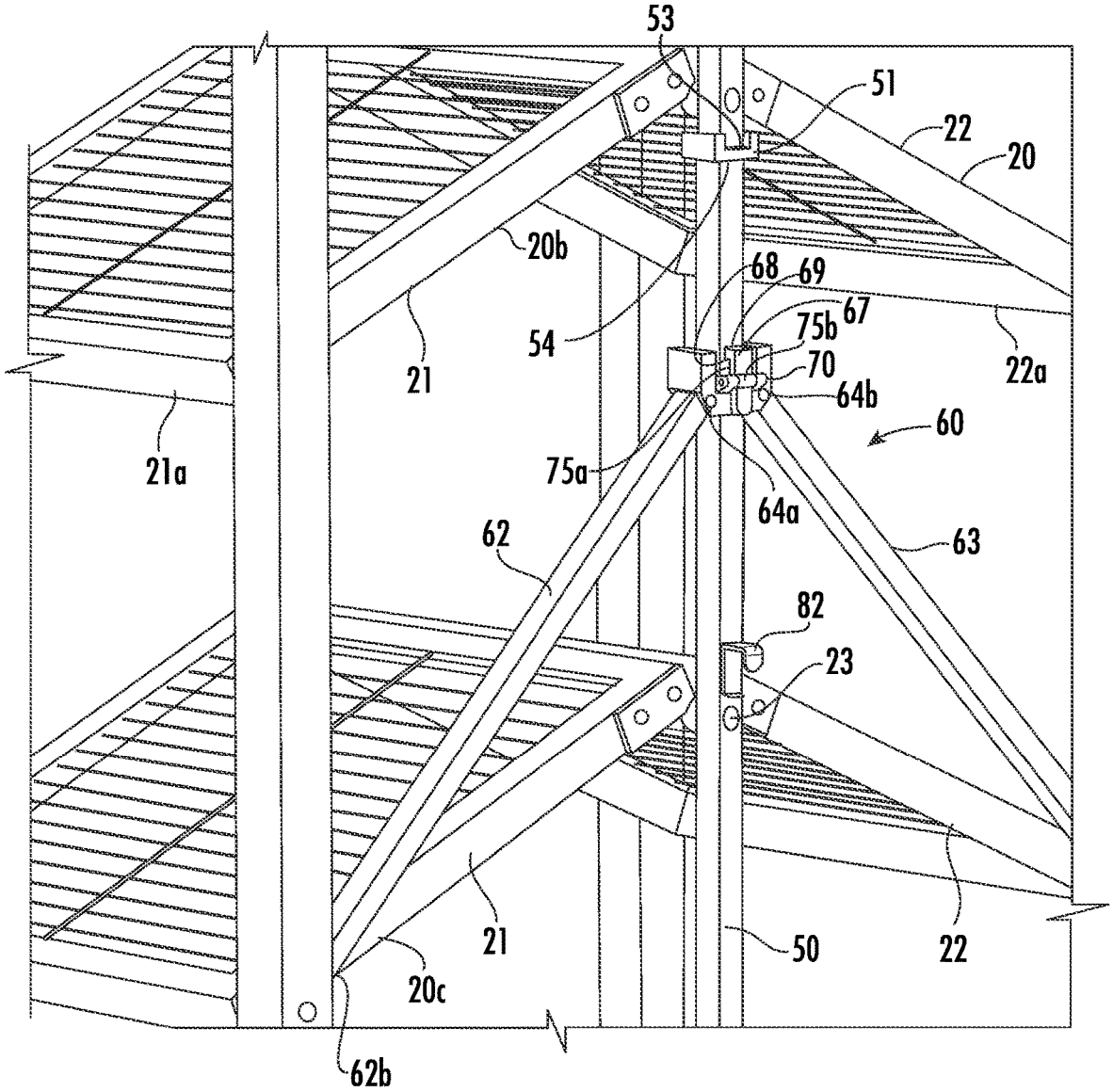
FIGS. 2B-2D provide sequential magnified views of a process of latching and unlatching a slide locking mechanism to fold and unfold the foldable shelving unit of FIG. 2A according to various embodiments described herein.
Figure 2C:
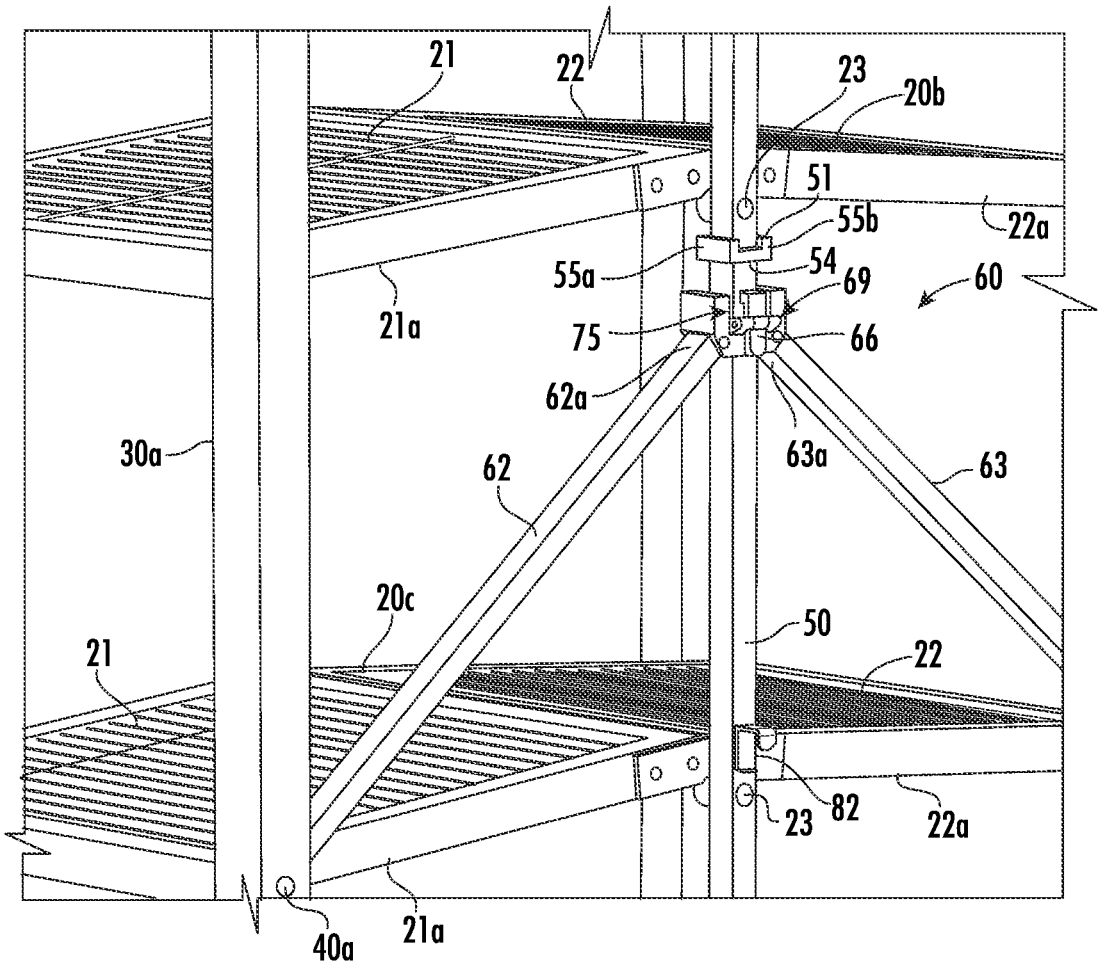
Figure 2D:
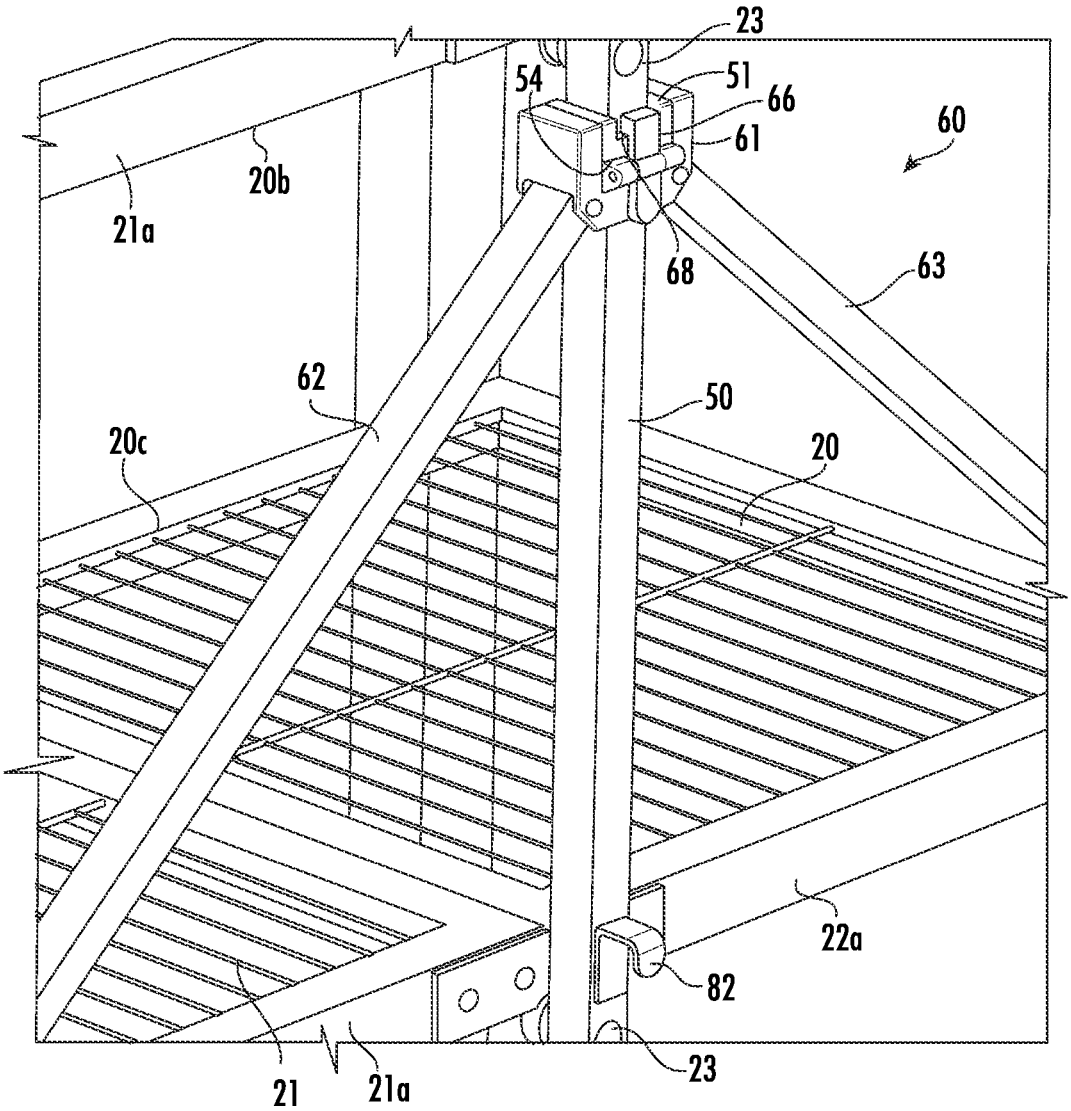

With reference to the magnified views shown in FIGS. 2B-2D, the foldable shelving unit 10 may include an optional hanger 82 for hanging the shelving. The hanger 82 may be located at any suitable location, typically along the rear facing side.

FIGS. 2B-2D also illustrate a process of latching and unlatching the slide locking mechanism to fold and unfold the foldable shelving unit 10. In FIG. 2B, the slider 61 is located below the stop 51 latched at the stop 51 and the shelf members 21, 22 are partially folded. The slider 61 may be slid upwardly along the slide rail 50 toward the stop 51 to further unfold the shelf members 21, 22 and increase the distance between the frame members 30*a*, 30*b* as shown in FIG. 2C. When the slider 61 is slid up to the stop 51, the upper surface of the projection 67 comprising the auto latching surface 69 engages a portion of the stop 51 below the latch surface 52 of the stop 51. Continued upward movement of the slider 61 along the slide rail 51 causes lifting of the projection 67 away from the slide rail 51, over the stop 51, to allow the bias of the latch 66 to extend the latch projection 67 over the latch surface 52 to interface the latch surface 68 therewith as shown in FIG. 2D. The lateral stop sides 55*a*, 55*b* and engagement surface 54 also insert into retention slot 75. When latched, the foldable shelving unit 10 is in an unfolded configuration suitable for providing a sturdy support for objects to be shelved. Engagement surfaces 54, 68 may be engaged or engage when weight is applied to shelves 20 to distribute the weight to the sides of the shelves, e.g., onto the frame members. Engagement of the engagement surfaces 54, 68 may also apply an outward unfolding force further stabilizing the unfolded configuration of the shelves 20.

To release the latch projection 67 from the stop 51, the release arm 71 may be pressed to pivot the latch 66 on pivot 70 to extend the latch projection 67 away from the slid rail 50 and clear the latch surface 52 of the stop 51. As exemplified in FIGS. 2C & 2B, the slider 62 may then be slid down the slide rail 50 to fold the foldable shelving 1 (see, e.g., FIG. 1A).

Stop 51 will typically be positioned at or just below a pivot 23; however, the stop 51 may be positioned at other locations along the slide rail 50. In some configurations, the stop 51 is positioned at or below a pivot 23 at a location wherein an angle of the connectors 62, 63 is between approximately 50 degrees and approximately 35 degrees relative to the shelf 20 the second ends 62*b*, 63*b* pivotably couple, when the latch 66 latches to the stop 51. However, other angles may be used. While the illustrated embodiments depict the connectors 62, 63 spanning less than a full vertical distance between shelves 20*b* and 20*c* in the unfolded configuration, in some embodiments, connectors 62, 63 may extend from the slider 61 beyond an immediately lower shelf 20*c* and pivotably connect to a frame member 30*a*, 30*b* at a lower position or to a lower shelf 20*d* and/or frame member 30*a*, 30*b*, e.g., at pivots 40*d*.

While the invention has been described in connection with various preferred embodiments, such is not intended to limit the scope of the invention to the particular form set forth, but on the contrary, it is intended to cover such alternatives, modifications, and equivalents as may be within the spirit and scope of the invention as defined by the appended claims.

For example, while the illustrated embodiments have been depicted as including four shelves, fewer or additional shelves may be used. In some embodiments, the slide rail may pivotably couple to fewer than all shelves. For example, the upper shelf may fold independent of the slide rail or may comprise a continuous shelf that may be attachable and releasable from the frame members at one end and pivotable relative to frame members at the other end.

As another example, while the illustrated embodiments are shown including a single slide locking mechanism, in some embodiments, multiple slide locking mechanisms may be provided along one or more slide rails. For example, a second slide locking mechanism along the same slide rail may be pivotably connected via connectors to a shelf above or below a first slide locking mechanism and/or to a frame member at a location above or below the connection point of the first slide locking mechanism. In one embodiment, the foldable shelving includes a second slide rail pivotably coupled to shelving members for lockable unfolding and folding as described herein. A second slide locking mechanism may be configured for slidable locking and unlocking along the second slide rail as also described herein. The second slidable locking mechanism may include connectors that pivotably connect to shelf members and/or frame members. In one example, a connector of each of the first and second slide locking mechanisms may pivotably couple to a same shelf member and/or frame member. The shelves may include more than two pivotably coupled shelf members wherein a connector of the first slide locking mechanism pivotably couples at a pivot between a second and a third shelf member, which may include a frame member, and a connector of the second slide lock mechanism couples to the same pivot as the connector of the first slide locking mechanism. In another example, the connectors may pivotable couple to different shelf members and/or frame members. The second slide rail may pivotably connect to the third shelf member and a fourth shelf member and/or a frame member. Folding the shelving unit may result in undersides of first and second shelf members directing toward each other and upper sides of second and third shelf members directing toward each other, and in some embodiments, lower sides of third and fourth shelf members directing toward each other. Other variations may also be used. For example, in one embodiment, the slide rail extends below the lower shelf to contact ground beneath the foldable shelving to provide an additional location of weight support.

This disclosure describes various elements, features, aspects, and advantages of various embodiments of the foldable shelving unit 10 and methods thereof. It is to be understood that certain descriptions of the various embodiments have been simplified to illustrate only those elements, features and aspects that are relevant to a more clear understanding of the disclosed embodiments, while eliminating, for purposes of brevity or clarity, other elements, features and aspects.

It is to be understood that while this description may use directional or relative positional language, foldable shelving may be used in multiple orientations, and such directional or relative positional language has been used to assist the reader in understanding the features and operations of the invention described herein and is not intended to be limiting.

Any references to "various embodiments," "certain embodiments," "some embodiments," "one embodiment," or "an embodiment" generally means that a particular element, feature and/or aspect described in the embodiment is included in at least one embodiment. The phrases "in various embodiments," "in certain embodiments," "in some embodiments," "in one embodiment," or "in an embodiment" may not refer to the same embodiment. Furthermore, the phrases "in one such embodiment" or "in certain such embodiments," while generally referring to and elaborating upon a preceding embodiment, is not intended to suggest that the elements, features, and aspects of the embodiment introduced by the phrase are limited to the preceding embodiment; rather, the phrase is provided to assist the reader in understanding the various elements, features, and aspects disclosed herein and it is to be understood that those having ordinary skill in the art will recognize that such elements, features, and aspects presented in the introduced embodiment may be applied in combination with other various combinations and sub-combinations of the elements, features, and aspects presented in the disclosed embodiments. The grammatical articles "one", "a", "an", and "the", as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and may be employed or used in an implementation of the described embodiments. Further, the use of a singular noun includes the plural, and the use of a plural noun includes the singular, unless the context of the usage requires otherwise.

It is to be appreciated that persons having ordinary skill in the art, upon considering the descriptions herein, will recognize that various combinations or sub-combinations of the various embodiments and other elements, features, and aspects may be desirable in particular implementations or applications. However, because such other elements, features, and aspects may be readily ascertained by persons having ordinary skill in the art upon considering the description herein, and are not necessary for a complete understanding of the disclosed embodiments, a description of such elements, features, and aspects may not be provided. As such, it is to be understood that the description set forth herein is merely exemplary and illustrative of the disclosed embodiments and is not intended to limit the scope of the invention as defined solely by the claims.

What is claimed is:

1. A foldable shelving unit, the unit comprising;
- one or more shelves, each shelf including a first shelf member and a second shelf member;
- a first frame member and a second frame member, the first frame member pivotably coupled to the first shelf member at a first pivot and the second frame member pivotably coupled to the second shelf member at a second pivot;
- a slide rail;
- a third pivot pivotably coupling the first shelf member, second shelf member, and slide rail;
- a stop fixed to the slide rail; and
- a slide locking mechanism comprising:
  - a slider configured to slide along the slide rail,
  - a first connector pivotably coupled to the slider at a first end and pivotably coupled to the first pivot at a second end,
  - a second connector pivotably coupled to the slider at a first end and pivotably coupled to the second pivot at a second end,
  - a latch configured to latch to the stop when the unit is in an unfolded configuration and unlatch from the stop to transition the unit to a folded configuration, and
  - an engagement surface to engage an engagement surface of the stop when the unit is in the unfolded configuration.

2. The unit of claim 1, wherein the latch is configured for auto latching.

3. The unit of claim 2, wherein the latch is biased toward the stop.

4. The unit of claim 3, wherein the latch includes a projection having an angled upper surface configured to engage the stop when the slider is slid toward the stop and progressively lift the projection as the slider slides a latch surface of the projection above a latch surface of the stop to allow the bias to position the latch surface of the projection over the latch surface of the stop.

5. The unit of claim 1, wherein the second end of the first connector positions between the first shelf member and the first frame member.

6. The unit of claim 5, wherein the second end of the second connector positions between the second shelf member and the second frame member.

7. The unit of claim 1, wherein the second end of the first connector positions more rearward than that of the first shelf member and the first frame member.

8. The unit of claim 7, wherein the second end of the second connector positions more rearward than the second shelf member and the second frame member.

9. The unit of claim 1, wherein when weight is positioned on the one or more shelves, the engagement surfaces of the slide locking mechanism and stop engage and downward directed force is applied to the slider.

10. The unit of claim 9, wherein the downward directed force on the slider is transferred to the first and second frame members by the first and second connectors.

11. The unit of claim 1, wherein the stop includes a slot to receive the latch.

12. The unit of claim 1, wherein the slider includes a slot to receive the stop.

13. The unit of claim 12, wherein the engagement surface of the slider is located along a lower surface of the slot.

14. The unit of claim 1, wherein the first ends of the first and second connectors pivotably couple to the slider at separate pivots.

15. The unit of claim 1, further comprising casters.

16. The unit of claim 1, further comprising a hanger.

* * * * *